US012123125B2

(12) United States Patent
Cho et al.

(10) Patent No.: US 12,123,125 B2
(45) Date of Patent: Oct. 22, 2024

(54) APPARATUS FOR TREATING LAUNDRY AND CONTROL METHOD THEREFOR

(71) Applicant: LG Electronics Inc., Seoul (KR)

(72) Inventors: Kichul Cho, Seoul (KR); Youngjae Lee, Seoul (KR); Inbo Sim, Seoul (KR)

(73) Assignee: LG Electronics Inc., Seoul (KR)

( * ) Notice: Subject to any disclaimer, the term of this patent is extended or adjusted under 35 U.S.C. 154(b) by 760 days.

(21) Appl. No.: 17/219,091

(22) Filed: Mar. 31, 2021

(65) Prior Publication Data

US 2021/0301449 A1 Sep. 30, 2021

(30) Foreign Application Priority Data

Mar. 31, 2020 (KR) ..... 10-2020-0039325

(51) Int. Cl.
*D06F 33/69* (2020.01)
*D06F 29/00* (2006.01)
(Continued)

(52) U.S. Cl.
CPC ..... *D06F 33/68* (2020.02); *D06F 29/005* (2013.01); *D06F 29/02* (2013.01); *D06F 33/63* (2020.02);
(Continued)

(58) Field of Classification Search
CPC ..... D06F 33/69; D06F 58/22; D06F 58/24; D06F 58/26; D06F 58/206; D06F 58/45; D06F 2105/34; D06F 2105/54
See application file for complete search history.

(56) References Cited

U.S. PATENT DOCUMENTS 6,282,928 B1 * 9/2001 Fukumoto ..... D06F 25/00 68/20
2018/0245273 A1 * 8/2018 Bocchino ..... D06F 58/22
2021/0262150 A1 * 8/2021 Lee ..... F28G 9/00

FOREIGN PATENT DOCUMENTS

DE 102010002661 9/2011
DE 102010027739 10/2011
(Continued)

OTHER PUBLICATIONS

Office Action in European Appln. No. 21165857.0, mailed on Apr. 26, 2023, 6 pages.
(Continued)

*Primary Examiner* — David G Cormier
(74) *Attorney, Agent, or Firm* — Fish & Richardson P.C.

(57) ABSTRACT

A laundry treating apparatus includes a drum, a duct circulating air through the drum, a heat exchanger in the duct, a water collector configured to water separated from air through the heat exchanger, a spray configured to spray water to the heat exchanger, a pump housing that is connected to the water collector and defines first and second pump outlets, an impeller moving water in the pump housing to the first pump outlet, a drainage housing, a housing connecting pipe connecting the second pump outlet to the drainage housing, a drain pipe discharging water in the drainage housing, and a drain valve controlling the drain pipe, and a switch housing connected to the first pump outlet, a first supply pipe connecting the switch housing to the spray, a second supply pipe connecting the switch housing to the drain pipe, and a switch valve controlling the first and second supply pipes.

8 Claims, 3 Drawing Sheets

(51) Int. Cl.

| | |
|---|---|
| ***D06F 29/02*** | (2006.01) |
| ***D06F 33/63*** | (2020.01) |
| ***D06F 33/68*** | (2020.01) |
| ***D06F 58/20*** | (2006.01) |
| ***D06F 58/24*** | (2006.01) |
| *D06F 101/20* | (2020.01) |

(52) U.S. Cl.
CPC ..... *D06F 58/206* (2013.01); *D06F 58/24* (2013.01); *D06F 2101/20* (2020.02)

(56) References Cited

FOREIGN PATENT DOCUMENTS

| | | |
|---|---|---|
| EP | 3366827 | 8/2018 |
| EP | 3868949 | 8/2021 |

OTHER PUBLICATIONS

Extended European Search Report in European Appln. No. 21165857.0, dated Aug. 18, 2021, 8 pages.

* cited by examiner

APPARATUS FOR TREATING LAUNDRY AND CONTROL METHOD THEREFOR

CROSS-REFERENCE TO RELATED APPLICATIONS

Pursuant to 35 U.S.C. § 119(a), this application claims the benefit of earlier filing date and right of priority to Korean Application No. 10-2020-0039325, filed on Mar. 31, 2020, the contents of which are hereby incorporated by reference herein in their entirety.

TECHNICAL FIELD

The present disclosure relates to an apparatus for treating laundry and control method therefor.

BACKGROUND

A laundry treatment device is the generic term for a device for washing laundry, a device for drying laundry, and a device for both washing and drying laundry.

A laundry treatment device capable of drying laundry according to a related art consists of a drum providing a storage space for laundry, a duct forming a flow path for resupplying air discharged from the drum to the drum, a first heat exchanger cooling air flowing into the duct from the drum so as to remove moisture contained in the air, a second heat exchanger heating the air having passed through the first heat exchanger, and a fan moving the air having passed through the second heat exchanger to the drum.

Since the air discharged from the drum is resupplied to the drum in a manner of dehumidification and heating through the heat exchangers in the above-structured laundry treatment device of the related art, it may cause a problem that foreign material such as lint and the like remains on the heat exchangers. To solve such a problem, the related art laundry treatment device is equipped with a filter for filtering air supplied to the first heat exchanger or a nozzle for spraying water to the heat exchanger (EP2691567B1).

The related art laundry treatment device configured to remove foreign material from the filter or heat exchanger by spraying water generally uses water (e.g., condensate water) discharged from the air passing through the first heat exchanger in the course of laundry drying. The mechanism for washing the heat exchanger using the condensate water needs a nozzle for spraying the condensate water to the first heat exchanger and a pump for supplying the condensate water to the nozzle.

The pump provided to the related art laundry treatment device is configured to include a pump housing, an impeller rotatably provided within the pump housing, a motor rotating the impeller, a flow path for supplying condensate water to the pump housing, and a flow path guiding the condensate water within the pump housing to the nozzle.

However, the above-configured laundry treatment device has a problem that condensate water remains within the pump housing. Namely, since the impeller needs to be rotatably provided within the pump housing, the impeller and a floor surface of the pump housing should be spaced apart from each other. Thus, it is difficult for the related art pump to prevent condensate water from remaining within the pump housing due to the pump structure.

SUMMARY

Accordingly, embodiments of the present disclosure are directed to an apparatus for treating laundry and control method therefor that substantially obviate one or more problems due to limitations and disadvantages of the related art.

One object of the present disclosure is to provide an apparatus for treating laundry and control method therefor, by which water can be prevented from remaining in a housing of a pump supplying water to a flow path for washing a heat exchanger.

Another object of the present disclosure is to provide an apparatus for treating laundry and control method therefor, in which a single pump is used to wash a heat exchanger and discharge water condensed from air passing through the heat exchanger.

Technical tasks obtainable from the present disclosure are non-limited by the above-mentioned technical tasks. And, other unmentioned technical tasks can be clearly understood from the following description by those having ordinary skill in the technical field to which the present disclosure pertains.

Additional advantages, objects, and features of the disclosure will be set forth in the disclosure herein as well as the accompanying drawings. Such aspects may also be appreciated by those skilled in the art based on the disclosure herein.

To achieve these objects and other advantages and in accordance with the purpose of the disclosure, as embodied and broadly described herein, an apparatus for treating laundry according to one embodiment of the present disclosure may include a drum provided within a cabinet to provide a space for storing the laundry therein, a duct discharging air in the drum to an outside of the drum and resupplying the discharged air into the drum, a fan enabling the air in the drum to be moved along the duct, a heat exchanger provided within the duct to dehumidify air and heat the dehumidified air, a water collecting part storing water removed from air passing through the heat exchanger, a spray part removing foreign material by spraying water to the heat exchanger, a pump having a pump housing connected to the water collecting part, first and second pump outlets enabling the pump housing to communicate with an external environment, and an impeller moving water in the pump housing to the first pump outlet, a drainage having a drainage housing, a housing connecting pipe connecting the second pump outlet and the drainage housing to each other, a drain pipe for discharging water in the drainage housing, and a drain valve controlling opening/closing of the drain pipe, and a flow path switch having a switch housing connected to the first pump outlet, a first supply pipe connecting the switch housing to the spray part, a second supply pipe connecting the switch housing to the drain pipe, and a switch valve controlling opening/closing of the first supply pipe and the second supply pipe, wherein based on opening the first supply pipe by the switch valve, the drain valve may be configured to close the drain pipe and wherein based on opening the second supply pipe by the switch valve, the drain valve may be configured to open the drain pipe.

Based on opening the first supply pipe by the switch valve, the drain valve may be configured to close the drain pipe. Based on opening the second supply pipe by the switch valve, the drain valve may be configured to open the drain pipe.

Based on activating the heat exchanger, the drain valve may be configured to close the drain pipe and the switch valve may be configured to close the first supply pipe and the second supply pipe.

In another aspect of the present disclosure, as embodied and broadly described herein, a method of controlling a laundry treatment device including: a drum providing a space for storing laundry therein; a duct discharging air in the drum to an outside of the drum and resupplying the discharged air into the drum; a heat exchanger provided within the duct to dehumidify air and heat the dehumidified air; a water collecting part storing water removed from air passing through the heat exchanger; a spray part removing foreign material by spraying water to the heat exchanger; a pump having a pump housing connected to the water collecting part, first and second pump outlets provided to the pump housing, and an impeller moving water in the pump housing to the first pump outlet; a drainage having a drainage housing, a housing connecting pipe connecting the second pump outlet and the drainage housing to each other, a drain pipe for discharging water in the drainage housing, and a drain valve controlling opening/closing of the drain pipe; and a flow path switch having a switch housing connected to the first pump outlet, a first supply pipe connecting the switch housing to the spray part, a second supply pipe connecting the switch housing to the drain pipe, and a switch valve controlling opening/closing of the first supply pipe and the second supply pipe, according to one embodiment of the present disclosure may include a second supply pipe opening step of controlling the switch valve to close the first supply pipe and open the second supply pipe, a drain pipe opening step of controlling the drain valve to open the drain pipe, and a drainage supply step of discharging the water in the pump housing to the second supply pipe and the housing connecting pipe by activating the impeller.

The second supply pipe and the drain pipe may be maintained in open state while the drainage supply step is in progress.

The second supply pipe opening step and the drain pipe opening step may be performed simultaneously.

The drain pipe opening step may be initiated prior to the second supply pipe opening step.

The method may further include a heat exchanger washing course of washing the heat exchanger by spraying water to the heat exchanger.

The heat exchanger washing course may further include a first supply pipe opening step of controlling the switch valve to open the first supply pipe and close the second supply pipe, a drain pipe closing step of closing the drain pipe by controlling the drain valve, and a spray part supply step of supplying the water in the pump housing to the first supply pipe by activating the impeller.

The method may further include a drying course of drying laundry in the drum by activating the heat exchanger, and the first supply pipe, the second supply pipe and the drain pipe may be maintained in closed state while the drying course is in progress.

Accordingly, the present disclosure provides the following effects and/or advantages.

Firstly, the present application provides an apparatus for treating laundry and control method therefor, by which water can be prevented from remaining in a housing of a pump supplying water to a flow path for washing a heat exchanger.

Secondly, the present application provides an apparatus for treating laundry and control method therefor, in which a single pump is used to wash a heat exchanger and discharge water condensed from air passing through the heat exchanger.

Effects obtainable from the present disclosure may be non-limited by the above-mentioned effects. And, other unmentioned effects can be clearly understood from the following description by those having ordinary skill in the technical field to which the present disclosure pertains.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. The above and other aspects, features, and advantages of the present disclosure will become more apparent upon consideration of the following description of preferred embodiments, taken in conjunction with the accompanying drawing figures. In the drawings.

DETAILED DESCRIPTION

Reference will now be made in detail to the preferred embodiments of the present disclosure, examples of which are illustrated in the accompanying drawings. Meanwhile, elements or control method of apparatuses which will be described below are only intended to describe the embodiments of the present disclosure and are not intended to restrict the scope of the present disclosure. Wherever possible, the same reference numbers will be used throughout the drawings to refer to the same or like parts.

Figure 1:
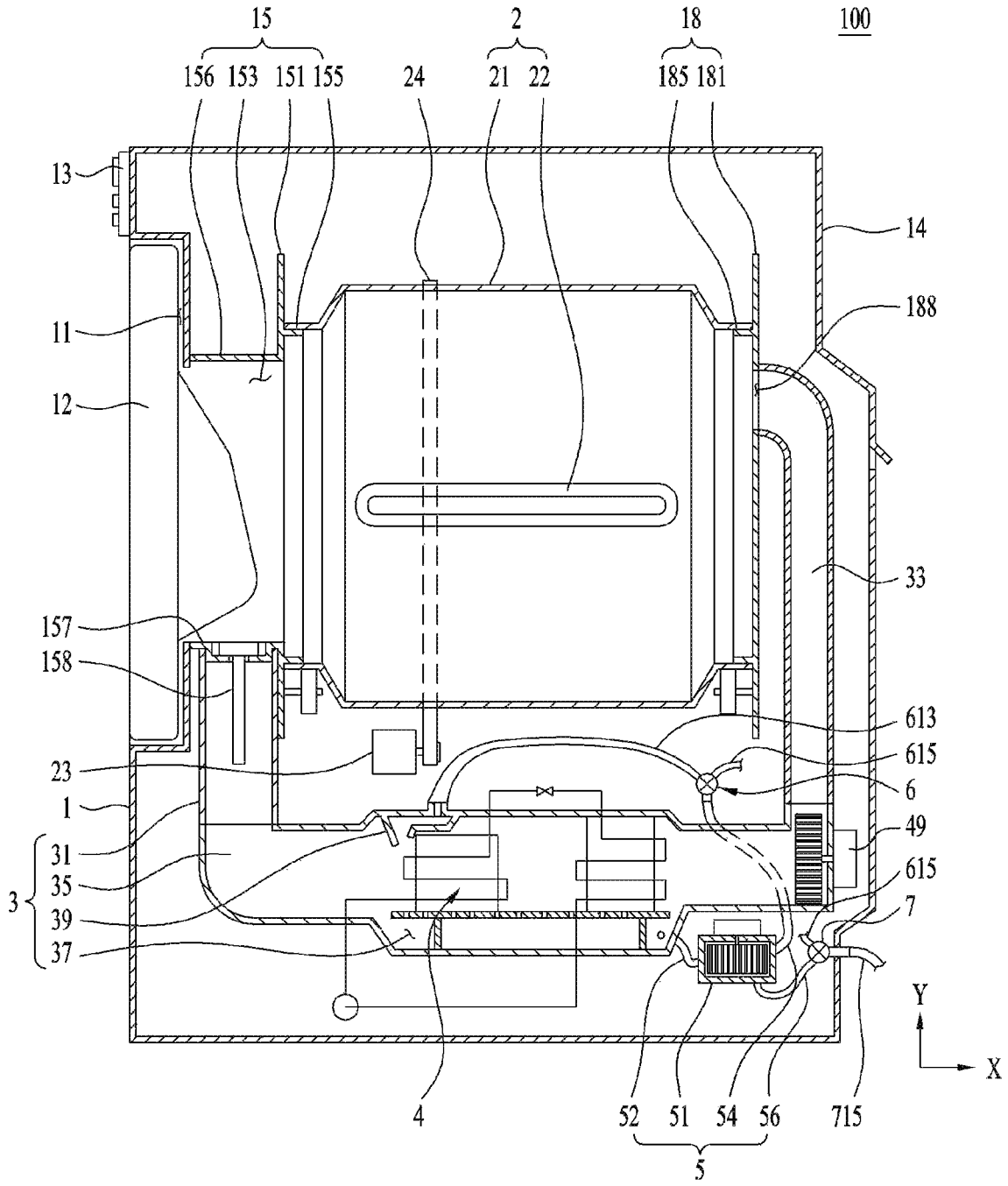
FIG. 1 illustrates one example of a laundry treatment device.

FIG. 1 illustrates one example of a laundry treatment device 100, which includes a cabinet 1, a drum 2 rotatably provided in the cabinet 1 to provide a storage space for laundry, a duct 3 forming a flow path for resupplying air discharged from the drum 2 to the drum 2, and a heat exchanger 4 dehumidifying, heating and resupplying the air flowing into the duct 3.

The cabinet 1 may include a front panel forming a front side of the laundry treatment device 100, a rear panel 14 forming a rear side of the laundry treatment device 100, and a top panel forming a top side of the laundry treatment device 100.

An entrance 11 configured to communicate with the drum 2 is provided to the front panel. The entrance 11 may be configured to be opened/closed by a door 12 rotatably coupled to the cabinet 1.

A control panel 13 is provided to the front panel. An input unit receiving an input of a control command from a user and a display unit outputting information such as a user-selectable control command and the like may be provided to the control panel 13. The input unit may include a power supply request unit making a request for power supply to the laundry treatment device 100, a course input unit enabling a user-desired course to be selected, and an execution request unit making a request for initiation of a user-selected course.

In case that the drum 2 includes a drum body 21 in a cylindrical shape, of which front and rear sides are open, a first support part 15 rotatably supporting the front side of the drum 2 and a second support part 18 rotatably supporting the rear side of the drum 2 may be provided within the cabinet 1.

The first support part 15 may include a first fixed body 151 fixed within the cabinet 1, a drum entrance 153 provided to perforate the first fixed body 151 so as to enable the entrance 11 and an inside of the drum body 21 to communicate with each other, and a first support body 155 provided to the first fixed body 151 so as to be inserted in the front side of the drum body 21.

The first fixed body 151 may be configured in any shape that can be provided with the drum entrance 153 and the first support body 155. The first support body 155 may be configured in a pipe shape protruding from the first fixed body 151 toward the drum body 21.

The first support part 15 may be configured to be connected to the entrance 11 through a connecting body 156. The connecting body 156 may be configured in a cylindrical shape that encloses the entrance 11. IN this case, the drum entrance 153 may include a perforated hole connected to the entrance 11 through the connecting body 156.

Figure 2:
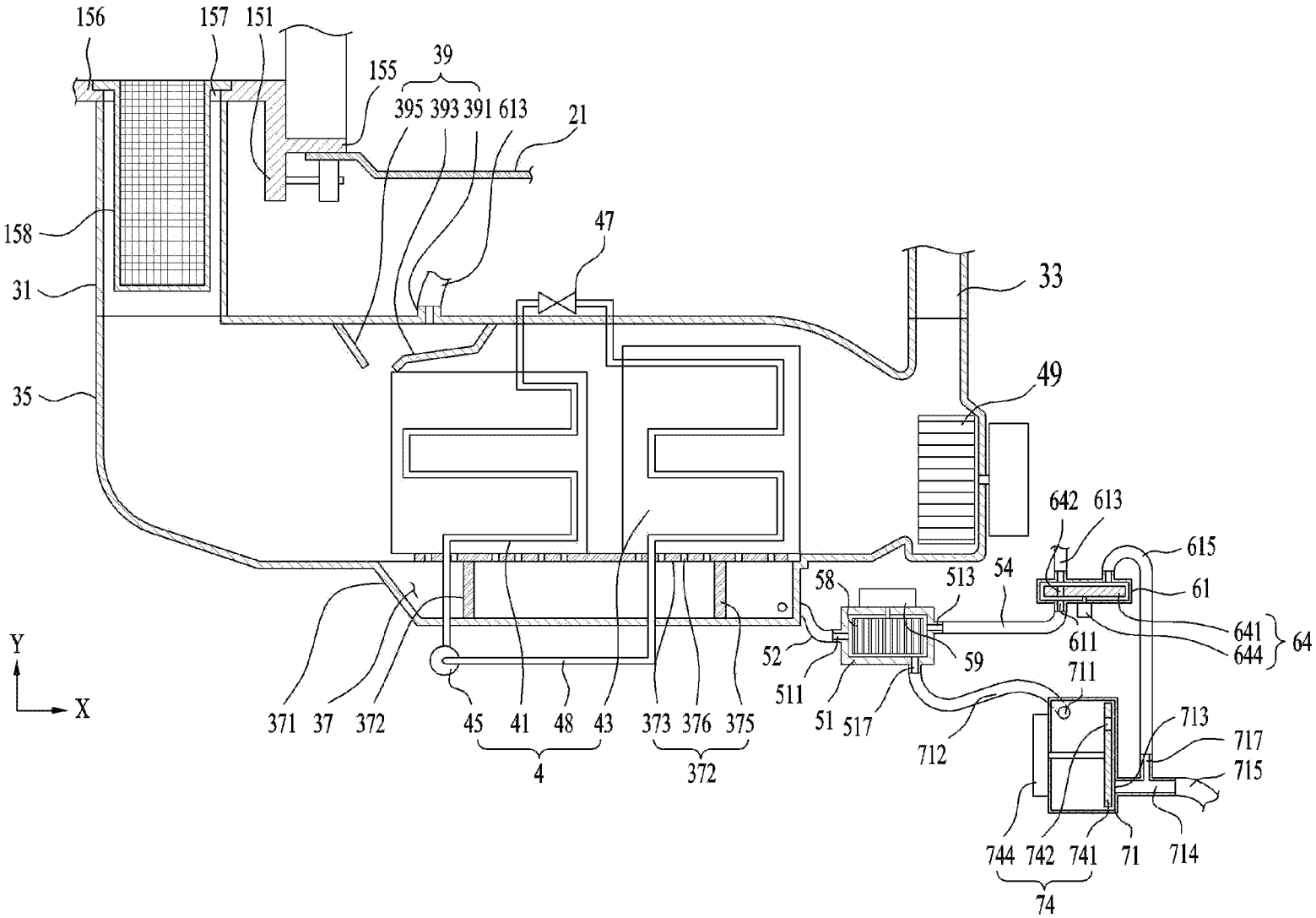
FIG. 2 to FIG. 3B illustrate examples of a duct, a heat exchanger, a pump, a flow path switch and a drainage.

An air outlet 157 communicating with the duct 3 may be provided to the connecting body 156. As shown in FIG. 2, the air outlet 157 may include a perforated hole that perforates the connecting body 157. Air in the drum body 21 may move to the duct 3 through the air outlet 157.

As shown in FIG. 1, the second support part 18 may include a second fixed body 181 fixed within the cabinet 1 and a second support body 185 provided to the second fixed body 181 so as to be inserted in the rear side of the drum body 21. An air inlet 188 is provided to eh second support part 18 in a manner of perforating the second fixe body 181 so as to enable the inside of the drum body 21 to communicate with the inside of the cabinet 1. In this case, the duct 3 may be configured to connect the air outlet 157 and the air inlet 188 to each other.

The drum body 21 may be configured in a hollow cylindrical shape, and a lifter 22 for stirring laundry may be provided to a circumferential surface of the drum body 21. The lifter 22 may include a board projected from the circumferential surface of the drum body 21 toward a rotation center of the drum body 21.

The drum body 21 is rotated by a drum drive unit that may include a motor 23 fixed within the cabinet 1, a pulley rotated by the motor 23, and a belt 24 connecting a circumferential surface of the pulley and a circumferential surface of the drum body 21 to each other.

The duct 3 may include an exhaust duct 31 connected to the air outlet 157, a supply duct 33 connected to the air inlet 188, and a connecting duct 35 connecting the exhaust duct 31 and the supply duct 33 to each other.

The heat exchanger 4 may include one of various devices capable of progressing dehumidification and heating of air flowing into the duct 3 sequentially. FIG. 1 shows an example of a case that the heat exchanger 4 includes a heat pump.

As shown in FIG. 2, the heat exchanger 4 includes a fan 49 moving air along the duct 3, a first heat exchanger (i.e., a heat absorbing part) 41 removing moisture from the air flowing into the duct 3, and a second heat exchanger (i.e., a heating part) 43 heating air having passed through the first heat exchanger 41.

The heat absorbing part 41 and the heating part 43 are disposed in order along a moving direction of air, and are connected to each other through a refrigerant pipe 48 that forms a circulation flow path of a refrigerant. The refrigerant is moved along the refrigerant pipe 48 by a compressor 45 located outside the duct 3, and a pressure adjuster 47 adjusting the pressure of the refrigerant having passed through the heating part 43 is provided to the refrigerator pipe 48.

The heat absorbing part 41 is a means for cooling air and evaporating a refrigerant in a manner of transferring heat of air flowing into the exhaust duct 31 to the refrigerant. The heating part 43 is a means for heating air and condensing a refrigerant in a manner of transferring heat of a refrigerant having passed through the compressor 435 to the air. In this case, moisture contained in the air will be collected on a floor surface of the connecting duct 35 along a surface of the heat absorbing part 41 when passing through the heat absorbing part 41.

In order to collect the water removed from the air passing through the heat absorbing part 41, a water collecting part 37 is provided to the laundry treatment device 100. The water collecting part 37 may be provided to anywhere inside the laundry treatment device 100 to store water discharged from the heat absorbing part 41. FIG. 2 shows one example of a case that the water collecting part 37 is located within the connecting duct 35.

The water collecting part 37 may include a water collecting body 371 fixed to the floor surface of the connecting duct 35 so as to communicate with the inside of the connecting duct 35. In order to prevent the heat absorbing part 41 and the heating part 43 from contacting with the water (i.e., condensate water) stored in the water collecting body 371, a heat exchanger support part 372 may be further provided within the water collecting part 371. The heat exchanger support part 371 may include a support plate 372 contacting with the heat absorbing part 41 and the heating part 43, a spacer 375 maintaining a space between the support plate 373 and the floor surface of the water collecting body 371, and a support part perforated hole 376 configured to perforate the support part 373.

The support plate perforated hole 376 may be provided only to a space in which the heat absorbing part 41 is supported in the space provided by the support plate 373, or to each of a space in which the heat absorbing part is supported and a space in which the heating part is supported. If the support plate perforated hole 376 is provided under the heating part 43, the water having moved to the heating part 43 along the support plate 373 may be discharged to the water collecting body 371 (preventing degradation of efficiency of heat transfer occurring when the heating part contacts with water).

In order to minimize that foreign material (e.g., lint, etc.) discharged from the drum body 21 stacks on the heat absorbing part 41 and the heating part 43, the laundry treatment device 100 may further include a filter 158 that filters air. The filter 158 may be detachably provided to the air outlet 157 to filter the air flowing into the exhaust duct 31.

Meanwhile, foreign material smaller than a size that can be filtered out by the filter 158 may remain in the heat absorbing part 41. To wash out the foreign material remaining in the heat absorbing part 41, the laundry treatment device 100 includes a spray part 39 supplying water to the heat absorbing part 41 and a pump 5 supplying water in the water collecting body 371 to the spray part 39.

The spray part 39 may include a duct perforated hole 391 configured to perforate a top surface of the connecting duct 35 and a first guide 393 guiding the water supplied to the duct perforated hole 391 to a front side of the heat absorbing part 41.

If the pressure of the water supplied to the duct perforated hole 391 is high, the water having flown into the duct perforated hole 391 may be possibly sprayed into the connecting duct 35 instead of being supplied to the front side of the heat absorbing part 41. To solve such a problem, the spray part 41 may be configured to further include a second guide 395 inclined downward toward the front side of the heat absorbing part 41 from the top side of the connecting duct 35. Therefore, at least one portion of the water having passed through the first guide 393 may be supplied to the front side of the heat absorbing part 41 through the second guide 395.

The pump 5 may include a pump housing 51 providing a space for storing water therein, a pump inlet 511 enabling water to flow into the pump housing 51, a first pump discharge pipe 513 discharging water in the pump housing 51 from the pump housing 51, and an impeller 58 provided within the pump housing 51. The first pump discharge pipe 513 may be provided to a circumferential surface of the pump housing 51 and the impeller 58 may be configured to be rotated by an impeller drive part 59 fixed to the pump housing 51.

The water collecting body 371 and the pump inlet 511 are connected together through a first connecting pipe 52. Hence, if the impeller 58 rotates, the water stored in the water collecting body 371 moves to the pump housing 51 through the first connecting pipe 52 and the pump inlet 511 and the water in the pump housing 51 may be discharged from the pump housing 51 through a first pump outlet 513.

Since the impeller 58 needs to be rotated within the pump housing 51, the above-configured pump 5 should maintain a state that a bottom end of the impeller 58 and a floor surface of the pump housing 51 are spaced apart from each other. Thus, the water that cannot be discharged by the impeller has no choice but to remain on the floor surface of the pump housing 51.

To solve the above-described problem, the laundry treatment device 100 may further include a drainage 7 (see FIG. 1) configured to discharge water (i.e., residual water) remaining in the pump housing 51.

As shown in FIG. 2, the drainage 7 includes a drainage housing 71 communicating with the pump housing 51 as a means for discharging the residual water in the pump housing 51 from the cabinet 1.

The drainage housing 71 may include a chamber providing a space for storing water therein, a housing inlet 711 communicating with the chamber by perforating the drainage housing 71, and a housing outlet 713. A second pump outlet 517 is further provided to the floor surface of the pump housing 51, and the housing inlet 711 may be connected to the second pump outlet 517 through a housing connecting pipe 712.

As the drainage housing 71 is configured to be located at a spot lower than the pump housing 51, the water in the pump housing 51 may move to the drainage housing 71 through the housing connecting pipe 712.

A drain pipe 714 is provided to the housing outlet 713, and a hose 715 guiding the water discharged from the drainage housing 71 to an outside of the cabinet 1 may be connected to the drain pipe 714. The hose 715 may be configured to connect the drain pipe 714 to a drain.

In order to control a residual water discharge timing point within the pump housing 51, a drain valve 74 configured to control the drain pipe 714 to be open or closed is further provided within the drainage housing 71. The drain valve 74 may include a valve body 741 rotatably provided within the drainage housing 71, a valve body perforated hole 742 configured to perforate the valve body 741, and a valve body drive part 744 configured to rotate the valve body 741.

The valve body 741 may include a disk that separates an inner space of the drainage housing 71 into a space connected to the housing inlet 711 and a space connected to the housing outlet 713.

The valve body perforated hole 742 may be configured to open the drain pipe 714 depending on a rotation angle of the valve body 741. If the valve body perforated hole 742 opens the drain pipe 714, the water in the pump housing 51 may be discharged to the hose 715 through the drainage housing 71. Yet, if the valve body perforated hole 742 closes the drain pipe 714, the water in the pump housing 51 may not be discharged to the hose 715.

In some implementations, the laundry treatment device 100 may further include a flow path switch 6 configured to supply (or guide) the water discharged from the first pump outlet 513 to the spray part 39 or the drain pipe 714.

The flow path switch 6 may include a switch housing 61 providing a space for storing water therein, a switch inlet 611 enabling water to flow into the switch housing 61, first and second switch outlets for discharging the water in the switch housing 61, and a switch valve 64 rotatably provided within the switch housing 61 to control the opening/closing of the first and second switch outlets.

The switch inlet 611 is connected to the first pump outlet 513 through a second connecting pipe 54. Therefore, if the impeller 58 rotates, the water in the pump housing 51 is supplied to the switch housing 61 through the second connecting pipe 54.

The first switch outlet may be connected to the duct perforated hole 391 of the spray part through a first supply pipe 613, and the second switch outlet may be connected to the drain pipe 714 through a second supply pipe 615. A communicating pipe 717 may be provided to the drain pipe 714. In this case, the second supply pipe 615 may be configured to connect the second switch outlet and the communicating pipe 717 to each other.

The switch valve 64 may include a switch body rotatably provided within the switch housing 51, a switch body perforated hole 642 configured to perforate the switch body 641 so as to open the first supply pipe 613 or the second supply pipe 614 depending on a rotation angle of the switch body 641, and a switch body drive part 644 rotating the switch body 641.

The switch body 641 may include a disk configured to separate an inside of the switch housing 61 into a space communicating with the switch inlet and a space communicating with the spray part supply pipe and the drainage supply pipe.

The above-described switch valve 64 may close both of the first switch outlet and the second switch outlet or open either the first switch outlet or the second switch outlet, depending on a rotation angle of the switch body 641 (e.g., depending on a position of the switch body perforated hole).

If the switch body 641 is rotated to open the first supply pipe 613 only, the valve body 741 may be rotated to close the drain pipe 714. In such a state, if the impeller 58 rotates, the water of the water collecting body 371 will be supplied to the spray part 39, whereby the laundry treatment device 100 may wash the heat absorbing part 41.

Namely, the laundry treatment device 100 may proceed with a course of washing the heat exchanger 4. As shown in FIG. 1, the heat exchanger washing source may include a first supply pipe opening step of opening the first supply pipe 613 and closing the second supply pipe 615 by controlling the switch valve 64, a drain pipe closing step of closing the drain pipe 714 by controlling the drain valve 74, and a spray part supply step of supplying the water in the pump housing 51 to the first supply pipe 613 by activating the impeller 58. In some implementations, the laundry treatment device 100 can include one or more controllers configured to control the switch valve 64 and the drain valve 74. For instance, the controllers can include an electric circuit or a processor.

Figure 3A:
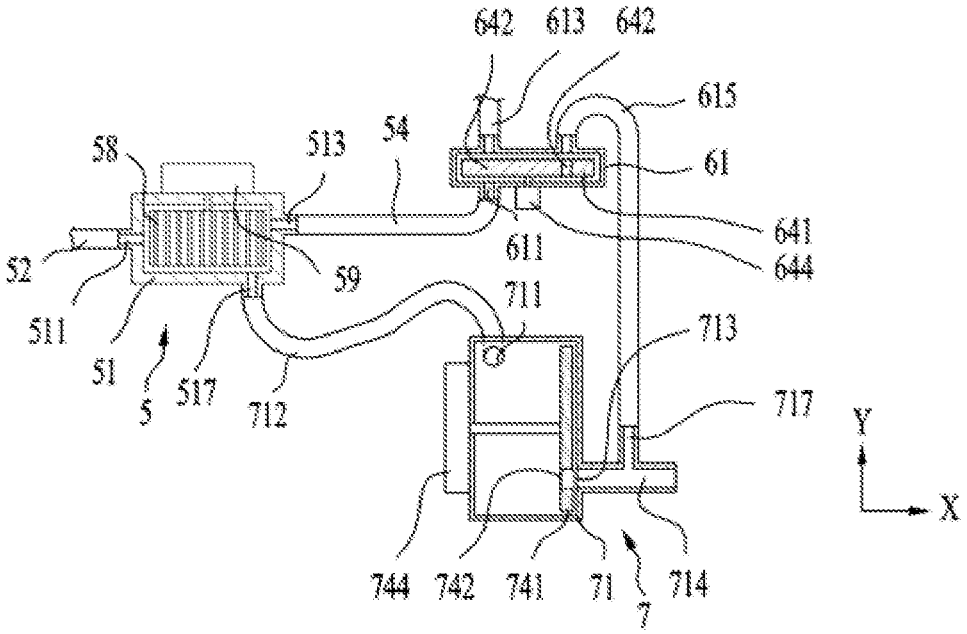

As shown in FIG. 3A, if the switch body 641 is rotated to open the second supply pipe 615 only, the valve body 741 may be rotated to a position of opening the drain pipe 714. In such a state, if the impeller 58 rotates, the water of the water collecting body 371 may move to the drain pipe 714 through the second connecting pipe 54, the second supply pipe 615, and the housing connecting pipe 712.

The drain course shown in FIG. 3A may include a second supply pipe opening step of closing the first supply pipe 613 and opening the second supply pipe 615 by controlling the switch valve 64, a drain pipe opening step of opening the drain pipe 714 by controlling the drain valve 74, and a drainage supply step of supplying the water in the pump housing to the second supply pipe 615 and the housing connecting pipe 712 by activating the impeller 58. During the drainage supply step, the second supply pipe 615 and the drain pipe 714 should be set to stay in open state.

Accordingly, the laundry treatment device 100 may reduce the time taken to drain water stored in the water collecting body 371 and prevent water from remaining in the pump housing 51.

The step of opening the second supply pipe 615 and the step of opening the drain pipe 714 may proceed simultaneously.

On the other hand, the step of opening the drain pipe 714 may be set to be initiated prior to the step of opening the second supply pipe 615. When foreign material is contained in the water supplied to the pump housing 51 from the water collecting body 371, it may maintain a state of sinking on the floor surface of the pump housing 151 unless the impeller 58 rotates. Thus, if the step of opening the drain pipe 714 is initiated prior to the step of opening the second supply pipe 615, the foreign material in the pump housing 51 may be removed easily and the problem of the foreign material remaining on the impeller 58 may be minimized.

Figure 3B:
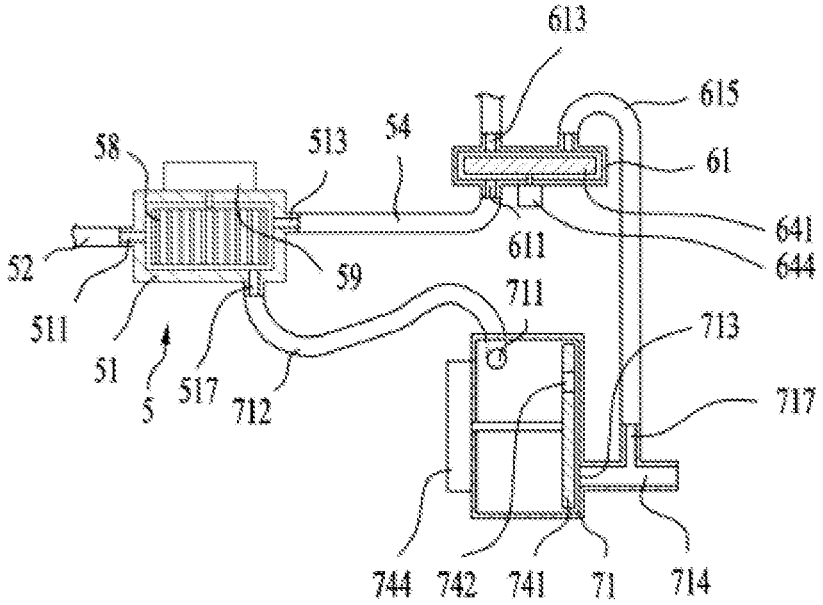

As shown in FIG. 3B, if the heat exchanger 4 is working, the drain valve 74 may be controlled to close the drain pipe 714 and the switch valve 64 may be controlled to close the first supply pipe 613 and the second supply pipe 615. Namely, the laundry treatment device 100 may close all the first supply pipe 613, the second supply pipe 615 and the drain pipe 714 in progress of a drying course. This is to minimize the loss of heat energy that circulates along the duct 3.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A method for controlling a laundry treatment device including a drum configured to receive laundry therein, a duct configured to circulate air discharged from the drum into the drum, a heat exchanger disposed in the duct and configured to dehumidify air in the duct and to heat the dehumidified air, a water collector configured to receive water separated from the air passing through the heat exchanger, a sprayer configured to spray the water to the heat exchanger to remove a foreign substance from the heat exchanger, a pump housing that is connected to the water collector and defines a first pump outlet and a second pump outlet, an impeller configured to move water in the pump housing to the first pump outlet, a drainage housing connected to the water collector, a housing connecting pipe that connects the second pump outlet to the drainage housing, a drain pipe configured to discharge water in the drainage housing, and a drain valve configured to control opening and closing of the drain pipe, a switch housing connected to the first pump outlet, a first supply pipe that connects the switch housing to the sprayer, a second supply pipe that connects the switch housing to the drain pipe, and a switch valve configured to control opening and closing of each of the first supply pipe and the second supply pipe, the method comprising:

controlling the switch valve to close the first supply pipe and open the second supply pipe;

controlling the drain valve to open the drain pipe; and discharging, by rotation of the impeller, the water in the pump housing to the second supply pipe and the housing connecting pipe.

2. The method of claim 1, further comprising:

maintaining the second supply pipe and the drain pipe in an open state while the pump housing discharging the water to the second supply pipe and the housing connecting pipe.

3. The method of claim 2, wherein controlling the switch valve and controlling the drain valve comprise opening the second supply pipe and the drain pipe simultaneously.

4. The method of claim 2, wherein controlling the drain valve comprises opening the drain pipe prior to opening the second supply pipe.

5. The method of claim 1, further comprising:

washing the heat exchanger by spraying water to the heat exchanger, wherein washing the heat exchanger comprises:

controlling the switch valve to open the first supply pipe and close the second supply pipe, controlling the drain valve to close the drain pipe, and supplying the water in the pump housing to the first supply pipe by rotation of the impeller.

6. The method of claim 5, further comprising:

drying the laundry in the drum by activating the heat exchanger; and maintaining the first supply pipe, the second supply pipe, and the drain pipe in a closed state while drying the laundry in the drum.

7. The method of claim 2, further comprising:

washing the heat exchanger by spraying water to the heat exchanger, wherein washing the heat exchanger comprises:

controlling the switch valve to open the first supply pipe and close the second supply pipe, controlling the drain valve to close the drain pipe, and supplying the water in the pump housing to the first supply pipe by rotation of the impeller.

8. The method of claim 7, further comprising:

drying the laundry in the drum by activating the heat exchanger;

maintaining the first supply pipe, the second supply pipe, and the drain pipe in a closed state while drying the laundry in the drum.

* * * * *